US009150317B2

(12) United States Patent
Hansen

(10) Patent No.: US 9,150,317 B2
(45) Date of Patent: Oct. 6, 2015

(54) DEVICE FOR MINIMIZING OXYGEN CONTENT

(76) Inventor: Bernd Hansen, Sulzbach-Laufen (DE)

( * ) Notice: Subject to any disclaimer, the term of this patent is extended or adjusted under 35 U.S.C. 154(b) by 1390 days.

(21) Appl. No.: 12/450,079

(22) PCT Filed: Mar. 27, 2008

(86) PCT No.: PCT/EP2008/002399
§ 371 (c)(1),
(2), (4) Date: Sep. 10, 2009

(87) PCT Pub. No.: WO2008/119494
PCT Pub. Date: Oct. 9, 2008

(65) Prior Publication Data

US 2010/0037566 A1 Feb. 18, 2010

(30) Foreign Application Priority Data

Mar. 29, 2007 (DE) ..... 10 2007 015 078

(51) Int. Cl.
*B65B 31/04* (2006.01)
*B65B 3/02* (2006.01)
*B65B 3/00* (2006.01)

(52) U.S. Cl.
CPC ..... *B65B 31/044* (2013.01); *B65B 3/022* (2013.01); *B65B 3/003* (2013.01); *B65B 3/02* (2013.01); *B65B 31/04* (2013.01)

(58) Field of Classification Search
IPC ..... B65B 31/04,31/044, 3/02, 3/022
See application file for complete search history.

(56) References Cited

U.S. PATENT DOCUMENTS

| | | | | | |
|---|---|---|---|---|---|
| 3,827,214 | A | * | 8/1974 | Naumann | 53/561 |
| 4,305,242 | A | * | 12/1981 | Barathe et al. | 53/512 |
| 4,926,613 | A | * | 5/1990 | Hansen | 53/433 |
| 5,551,213 | A | * | 9/1996 | Koelsch et al. | 53/434 |
| 5,961,039 | A | | 10/1999 | Chamot et al. | |
| 6,112,780 | A | | 9/2000 | Meheen | |

FOREIGN PATENT DOCUMENTS

| | | | |
|---|---|---|---|
| DE | 1 566 547 | A | 1/1970 |
| EP | 1 343 693 | B1 | 9/2003 |
| JP | 2004-147824 | P1 | 5/1992 |
| JP | 2002-293398 | | 10/2002 |
| JP | 2004-042961 | A | 2/2004 |
| JP | 2004 217246 | A | 8/2004 |
| JP | 2005-172195 | | 6/2005 |

* cited by examiner

*Primary Examiner* — Christopher Harmon
(74) *Attorney, Agent, or Firm* — Roylance, Abrams, Berdo and Goodman LLP

(57) ABSTRACT

A device minimizes the oxygen content in containers provided with a displacement medium or fluid by a feed unit (20). The displacement medium displaces oxygen from the container before closing. The food device (20) has one medium feed channel to introduce the displacement medium into the container and being at least partially a component of a filling device (26) for filling the container. The filling device (26) has a filling mandrel (17) with a filling channel (28), from which the media feed channel extends in a separated manner. The filling mandrel (17) has at least one further medium transport channel. The filling channel (28) is guided at its free cross-section in a ring channel region of the filling mandrel (17) having a larger cross-section. The filling channel (28) separates the medium feed channel from the medium transport channel within the ring channel region in a fluid-tight manner.

13 Claims, 3 Drawing Sheets

DEVICE FOR MINIMIZING OXYGEN CONTENT

FIELD OF THE INVENTION

The invention relates to a device for minimizing oxygen content for containers to be filled, such as ampules. The containers are preferably produced according to a blow, fill and seal process and can be provided by a supply device with a displacement medium to displace the oxygen out of the container before sealing it. The supply device has at least one medium supply channel for supplying the displacement medium to the container and being at least partially a component of a filling device for filling the container. The filling device has a filling mandrel with a filling channel, separated from the medium supply channel, and has at least one other medium transport channel.

BACKGROUND OF THE INVENTION

EP 1 343 693 B1 discloses a device for producing and filling containers such as ampules, with at least one mold having movable mold walls and receiving at least one extruded tube of plasticized plastic material. The mold parts can be closed to weld the leading end of the tube to form a container bottom by welding edges located on the mold parts. A device for producing a pressure gradient acts on the tube and widens it for forcing the container on the mold walls. A movable separating element can be moved to form a fill opening by cutting the tube above the mold between a withdrawn base position and a working position. A transfer device moves the mold into a filling position for filling the container through the fill opening. A sterile barrier is provided in a positional arrangement and with dimensions such that it is located in the working position of the separating element above the path of motion of the mold leading into the fill position. The sterile barrier is a plate heated to a germ-killing temperature and can be moved together with a blade which used as a separating element. This European patent also discloses a production method for these containers using the device.

When highly sensitive products are produced, for example in the form of special pharmaceuticals requiring satisfaction of international standards for aseptic packaging, the mold, when moved into the filling position, is located under a sterile filling chamber (ASR) in which sterile air flows over the open fill opening of the container and forms effective protection against the penetration of germs until after completion of the filling process and the movable head jaws of the mold are closed to form the head closure of the container by a combined vacuum welding process. The sterile barrier prevents foreign bodies from being able to fall into the open fill opening after the tube is severed and before the mold has reached the sterile filling chamber (ASR). During this segment of the process, the sterile barrier also prevents objectionable influx of germs into the fill opening.

Oxygen-sensitive products including high quality pharmaceuticals added to the container, such as ampules, then come into contact with residual oxygen content in the container leading to damage, especially in the form of oxidation on the added product. This exposure is accompanied by a distinct reduction of possible storage life. Accordingly, for sensitive products a remaining portion of oxygen in the head space of the container kept free of the added product of less than 0.5%, preferably of less than 0.2%, is currently required. These requirements are not adequately satisfied either by the sterile barrier device or other known production methods together with devices as are shown, for example, by U.S. Pat. No. 5,961,039 or JP-A-4147824.

This disadvantage ultimately also applies to devices minimizing the oxygen content for containers to be filled, such as ampules, with a displacement medium supplied by a supply device to displace the oxygen from the container before it is sealed. Thus JP 2004-042961 AA discloses a device in which a supply device moved over the free container opening of a filled container blows inert gas as a displacement medium in the direction of the container to reduce the oxygen content by displacement out of the container opening.

DE 1 566 547 A discloses a process for filling and sealing ampules as containers. A filling mandrel with a filling channel supplies the product to be placed in the container and is encompassed in a concentric arrangement by a medium supply channel surrounded to the outside by one wall part of the supply device. The medium supply channel supplies a displacement medium in the form of an inert gas to minimize the oxygen content within the container.

U.S. Pat. No. 6,112,780 discloses a generic device for minimizing the oxygen content for containers to be filled, such as bottle products, with a supply device having different medium transport channels in a concentric arrangement. The innermost channel forms the filling channel of a filling mandrel. A medium supply channel encompasses the filling channel for removing the displacement medium in the form of an inert gas and is in turn surrounded by a medium drain channel for removing the displacement medium together with the oxygen from the container (3-tube solution). In one especially preferred embodiment of the known device for minimizing the oxygen content, another medium supply channel in a concentric arrangement between the first medium supply channel and the outermost medium drain channel moves the displacement medium pulsed into the interior of the container with the added product (4-tube design). In another alternative configuration of the known solution, space permitting, in the container, the indicated medium channels can be provided separated from one another and next to one another in a line within the device. The minimization device is geometrically large in each version of the solution in the area of medium supply leading to large volumes of oxygen to be displaced. This known solution is not suitable either for producing the required setpoints of 0.2 to 0.5% residual oxygen content in the free head area of the container.

SUMMARY OF THE INVENTION

An object of the invention is to provide an improved device during the production process, enabling minimization of the oxygen content to the required setpoints of 0.2 to 0.5% residual oxygen content in the free head area of the container.

This object is basically achieved with a device where the filling channel has a free cross section guided in a ring channel region of the filling mandrel. That region is larger in cross section. Within the ring channel region, the filling channel separates medium-tight the medium supply channel from the medium transport channel. A very small device for minimizing the oxygen content for containers to be filled is then provided so that less "dead space" is formed which could fill with air which then can no longer be displaced in order to achieve the low residual oxygen contents of 0.2 to 0.5% of the oxygen otherwise present. The displacement medium, preferably a noble gas such as argon or an inert gas such as nitrogen gas, can be flushed by the supply device into the container such that it almost completely displaces the residual oxygen from the container before it is sealed. The oxidation processes adversely affecting the extremely oxygen-sensitive products stored in the container are avoided to permit a long storage capacity of the overall product.

In one preferred embodiment of the device according to the invention, the medium transport channel is used to remove the displacement medium together with the oxygen from the respective container, or to supply the displacement medium to the container. In the former case the displacement medium is supplied by the medium supply channel, and the medium transport channel is made as a medium drain channel to remove the displacement medium with the oxygen from the container opening. In the latter case the medium transport channel is used as another medium supply channel so that in spite of the supply situation which is kept small by the installation space a maximum of displacement medium to be supplied is achieved to minimize the oxygen content in an extremely efficient manner. In the case in which the displacement medium is supplied both by the medium supply channel and by the medium transport channel, the medium together with the atmospheric oxygen to be displaced can also be displaced outside of the supply device out of the container interior directly into the exterior.

Minimization of the required installation space is gained when the filling channel, the medium supply channel and the medium transport channel are located medium-tight separately from one another within the ring channel region of the filling mandrel and have the same input and/or output directions. The resulting parallel arrangement of the channels also allows streamlined transport of the individual media.

In one especially preferred embodiment of the device according to the invention, the ring channel region of the filling mandrel viewed in cross section is made circular. The wall of the filling mandrel bordering the filling channel forms an oval reduced in cross section in one transverse direction and in the longitudinal direction pushes against the inside wall of the circular ring channel region to separate from one another and to form sickle-shaped free cross sections of the medium supply channel and the medium transport channel. In this way all medium channels are combined centrally in the supply device in an especially space-saving manner.

These displacement results can be still further improved when another medium channel, preferably made as a medium supply channel, is in a concentric arrangement to the wall of the filling mandrel and encompassing it. The other medium channel is chambered to the outside by another wall of the supply device. In addition or alternatively, the surrounding region of the container to be filled at the time can be provided at least partially with a blocking medium by another supply device. In this way the oxygen content in the ambient region of the container opening can also be reduced to improve the result of minimization of oxygen content.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 2:
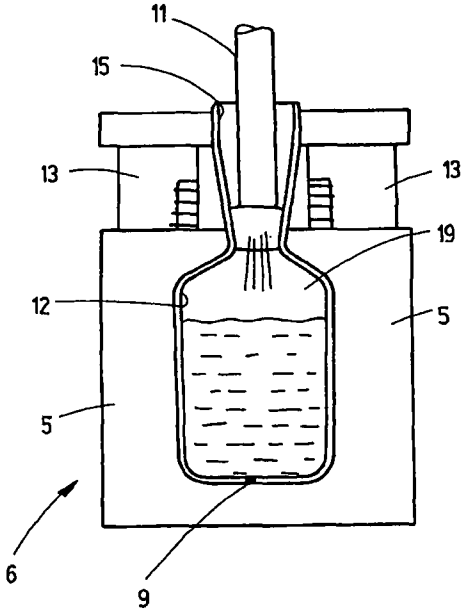
FIG. 2 is a side elevational view of the partially closed blow mold or FIG. 1 after transfer into the filling position and after forming the container to be filled.
Figure 1:
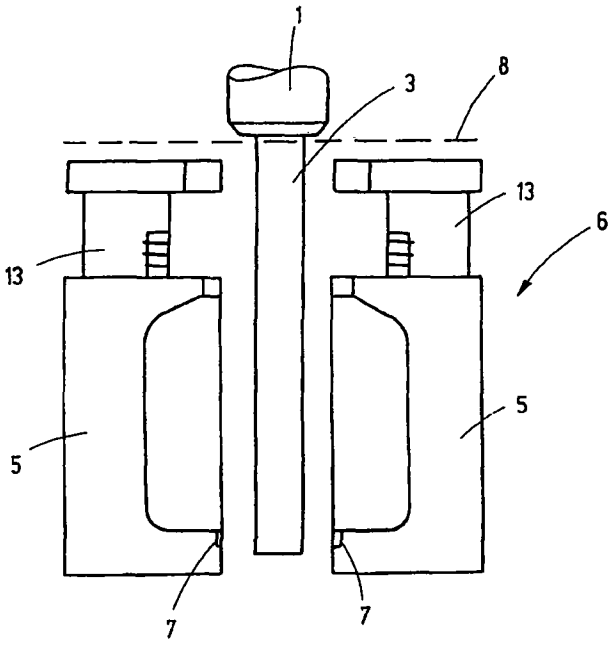
FIG. 1 is a schematically simplified side elevational view of an open blow mold and an extrusion head located above it for formation of tubing of plasticized plastic material.

FIGS. 1 and 2 show parts of a device as is used within the framework of the known Bottelpack® system for producing plastic containers in a blow molding process. By an extruder device 1, tubing 3 of molten plastic material is extruded between the two mold halves 5 of a mold 6 shown in the opened state in FIG. 1. After extruding the tubing 3 into the opened mold 6, the tubing 3 is severed between the nozzle outlet of the extruder device 1 and the top of the mold 6. FIG. 1 shows the cutting line as a broken line 8.

FIG. 2 shows the mold 6 in the partially closed state. The shaping parts for the main part of the container 12 formed from the tubing 3, specifically the mold halves 5, are moved together. The bottom-side welding edges 7 on the lower end of the tubing 3 execute a welding process to seal the tubing 3 on a bottom-side weld 9.

FIG. 2 shows the mold 6 in the filling position into which the mold is pushed sideways relative to the position shown in FIG. 1 and aligned to the extruder device 1. In this filling position, the container 12 formed beforehand, in which blowing air has been blown in through the open fill opening 15 by a blowing mandrel (not shown), is filled by the fill opening 15 with a filler material, for example in the form of a liquid pharmaceutical. FIG. 2 shows the end of the filling mandrel 17 inserted into the fill opening 15 for this purpose. Instead of the filling mandrel 17 and a previously inserted blowing mandrel, the container can also be formed and filled by a combined blow mold-filling mandrel. The container 12 can also be molded, instead with compressed air added by the blowing mandrel, with a vacuum applied to the mold. Both methods can also be combined with one another.

In the filling position shown in FIG. 2, the mold is underneath a sterile filling chamber (ASR) (not shown) in FIG. 2 for the sake of simplicity and acting as an aseptic shield of the fill opening 15 formed by the preceding cutting process on the tubing 3 on the cutting line 8 in FIG. 1. After filling the container 12, the filling mandrel 17 is moved away to the top and the still open movable upper welding jaws 13 of the mold 6 are moved together to affect molding on the container neck, and/or to seal it at the same time by welding. With the welding jaws 13 shown in FIGS. 1 and 2, the container neck can be formed with an external thread for a screw cap provided in addition to sealing by welding, for example in the form of a screw cap with a puncture mandrel located therein. Furthermore, several containers can be molded, filled and sealed in successive cavities of a molding tool (not shown).

Figures 3, 4:
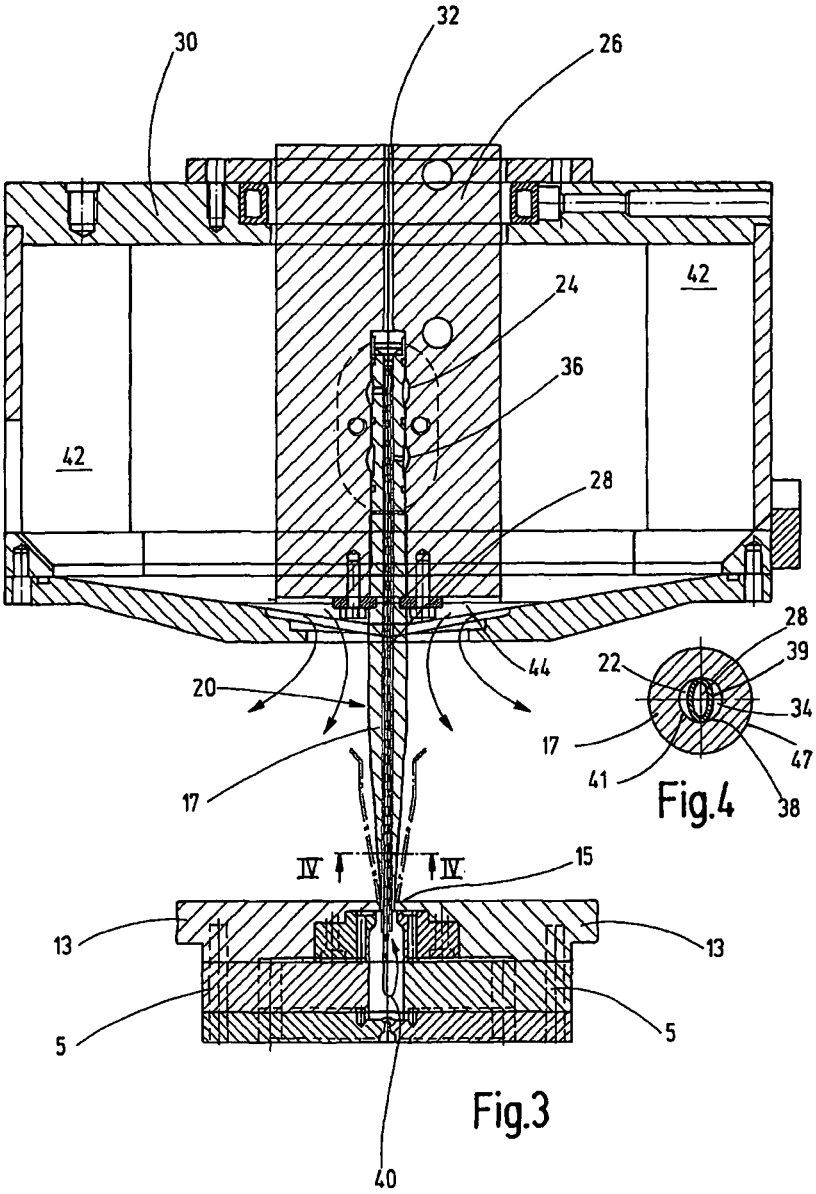
FIG. 3 is a side elevational view in section of the device according to a first exemplary embodiment of the invention together with a cross section of part of the molding device as shown in FIGS. 1 and 2.
FIG. 4 is a top plan view of the device in section taken along line IV-IV in FIG. 3.
Figure 5:
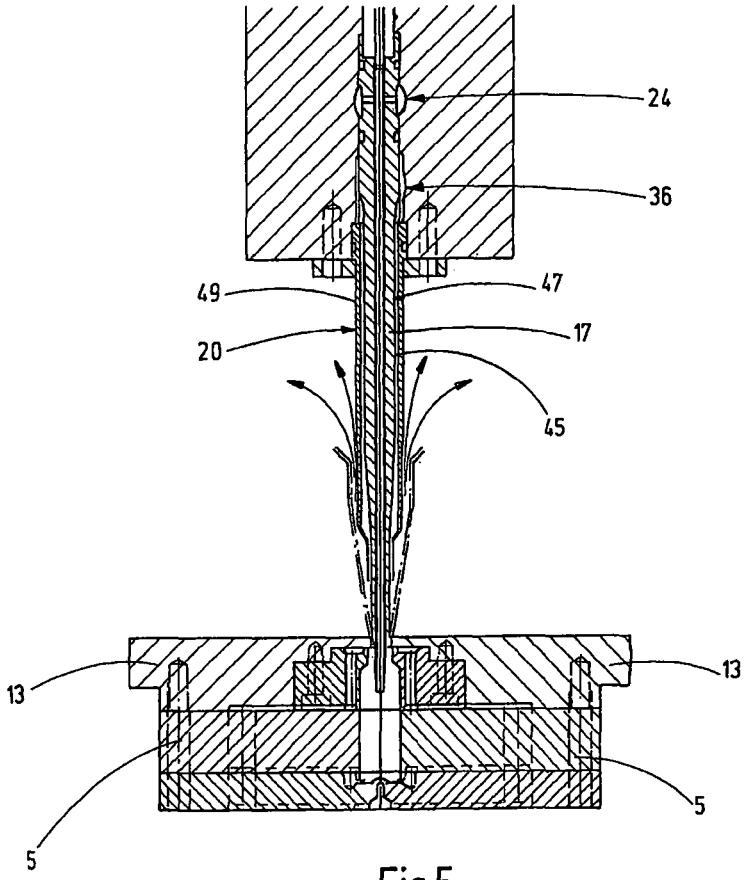
FIG. 5 is a side elevational view in section of the device according to a second exemplary an embodiment of the invention and simplified relative to the design as shown in FIG. 1, in a longitudinal section.

The molding tools 5, 13 shown in FIGS. 1 and 2, viewed in the direction of FIGS. 3 and 5, analogously are shown. The device according to the invention is now used to minimize the oxygen content for the containers 12 to be filled and preferably produced completely according to a blow, fill and seal process. The pertinent oxygen contents are located in particular in the cavity 19 as shown in FIG. 2 between the maximum fill level of the added product and the container closure on the top of its head.

To displace the remaining residual oxygen out of the cavity 19, a supply device 20 supplies the displacement medium to the cavity 19 to displace the oxygen out of the container 12 before sealing it. The displacement medium is preferably an inert gas such as nitrogen gas. The supply device 20 has a medium supply channel 22 for the nitrogen gas supplied to the cavity 19 of the container 12. This medium supply channel 22 is shown in FIG. 4 in a cross section through the supply device 20 along line IV-IV.

As FIG. 3 shows, the medium supply channel 22 on the top end part of the minimization device, transitions into a widened ring channel 24 via which nitrogen gas as the displacement medium can be supplied from the outside by suitable transport channels (not shown). As FIGS. 3 and 4 furthermore show, the supply device 20 in this respect is a component of a filling device 26, by which the container 12 can be filled with the product to be stored. To fill the container 1, the filling device 26 extends back onto the filling mandrel 17 which has a filling channel 28 located in the middle. The filling mandrel 17 on its free end, the top end as viewed in FIG. 3, is held in a receiving device 30 which is conventional for this purpose. Via middle channel 32 of the receiving device 30 the product is supplied to the container 12. Since these receiving and supply devices are conventional, they are not described in further detail.

The filling mandrel 17 has another medium transport channel 34 as a drain channel shown only in cross section in FIG. 4 and used to remove the displacement medium together with the oxygen from the remaining cavity 19 of the container 12. This medium drain channel 34 also ends with its free end, the top end viewed in the direction of FIG. 3 in another ring channel 36 located underneath the first ring channel 24 and connected to the drain line (not shown) of the entire device. The nitrogen gas as the displacement medium together with the residual oxygen can be removed from the container 12 via channels 34, 36 and the drain line.

By a vacuum device (not shown), this removal can be further supported. The negative pressure to be set should be such that the product added to the container 12 is not unintentionally exhausted from it. The amounts of displacement medium to be supplied, such as nitrogen gas, are also oriented to the free head cross sections of the container 12 together with the free volumes of oxygen within the cavity 19.

Otherwise the filling channel 28 as well as the medium or fluid supply channel 22 and the medium drain channel 34 extend parallel to one another but separately from one another within the elongated filling mandrel 17. This separation of media is apparent especially from the cross section shown in FIG. 4 indicating that the filling channel 28 with its free cross section is routed in a ring channel region 38 which is larger in cross section, as already mentioned. The filling channel 28 separates the respective medium supply channel 22 gastight and fluid-tight from the respective medium drain channel 34. For this purpose, the ring channel region 38 viewed in cross section is made circular. The wall 39 delimiting the filling channel 28 forms an oval reduced in cross section and, in the longitudinal direction, adjoins the inside wall 41 of the circular ring channel region 38 to separate the sickle-shaped free cross sections of the channels 22 and 34 from one another. In this way, the desired medium or fluid transport is achieved in an extremely narrow installation space within the filling mandrel 17. After emergence of the displacement medium or fluid from the medium supply channel 22 in the reverse arrow direction 40, re-entry of the displacement medium takes place with the residual oxygen into the medium drain channel 34. In this way, except for extremely miniscule amounts, the residual oxygen content in the cavity 19 can be reduced before actual sealing of the container by the upper welding jaws 13.

As FIG. 3 shows, by the supply spaces 42 of another supply device, additionally a blocking medium, preferably in the form of a nitrogen gas, can be supplied to the receiving device 30. The medium viewed in the direction of FIG. 3 emerges downwardly into the exterior on the bottom of the receiving device 30 by an annular blocking channel 44 forming a blocking curtain formed from the nitrogen gas that helps prevent free entry of ambient oxygen in the direction of the free fill opening 15 of the container 12. Based on this measure the residual oxygen content in the cavity 19 of the container 12 can be further minimized if necessary. The flow direction of the nitrogen gas is indicated with arrows.

The second embodiment as shown in FIG. 5 corresponds in terms of the fundamental structure relating to the supply device 20 and the filling device 26 to the mandrel-like structure as shown in FIG. 3. The displacement medium, preferably in the form of pressurized nitrogen gas, is supplied by way of the two channels 24 and 36 and is blown at the same time into the interior of the container 12 by the two opposite medium channels 22 and 34. This blowing can also take place during the filling process by the filling channel 28 located in the middle. Excess nitrogen gas is then, as the exit arrows shown, blown out into the exterior and in doing so entrains the residual oxygen. In this respect this modified embodiment minimization of the oxygen content in the container 12 is possible. By continuous supply of nitrogen in this way the air in the head region of the container 12, as shown, is displaced to the outside. In order to be able to ensure an efficient filing process, preferably the free end of the filling mandrel 17 and, accordingly, the filling channel 28 projects in the axial direction relative to the free entry and exit ends of the medium channels 22 and 34. In this embodiment therefore the medium transport channel 34 is also used as an additional medium supply channel.

A further medium channel 45 according to the embodiment shown in FIG. 5 on the peripheral side encloses the wall 47 of the filling mandrel 17 and is chambered to the outside by another wall 49 of the supply device 20. The medium channel 45 is supplied with the displacement medium by the channel 36. As follows from FIG. 5, the free end of the medium channel 45 is set back in turn relative to the free end of the filling mandrel 17 to achieve an effective blocking curtain by a blocking medium such as inert gas for the container opening. Advantageously, the blocking gas is blown into the still open mold tubing for the container 12 when the filling mandrel 17 is already engaged in lifting. Inert gas flows permanently through the external medium channel 45 until the head jaw 13 of the molding tool is closed to close the container opening. The medium channel 45 encompassing the filling mandrel 17 as shown in FIG. 5 is combined with the device shown in FIG. 3 such that the medium channel 45 encompasses the filling mandrel 17 with the other medium channels 22, 28, 34 to equally form a blocking gas curtain relative to the ambient air. This arrangement is especially advantageous when the filling mandrel 17 is engaged in lifting.

With the device according to the invention, the residual oxygen in the container products can be pressurized to less than 0.5% and lower into the range of 0.2% and less.

While various embodiments have been chosen to illustrate the invention, it will be understood by those skilled in the art that various changes and modifications can be made therein without departing from the scope of the invention as defined in the appended claims.

What is claimed is:

1. A device for minimizing oxygen content in containers to be filled, comprising:

a filling device conveying a product to fill an open container, said filling device having a filling mandrel with a filling channel;

a supply device conveying a displacing fluid to displace oxygen out of the container before sealing of the container, said supply device having a first medium supply channel delivering the displacement fluid to the container and being a component of the filling device, said filling channel and said first medium supply channel being separated along entire lengths thereof;

a medium transport channel in said filling device having a free cross section;

an annular and circular channel region in said filling mandrel and having a cross section larger than a cross section at said medium transport channel, said medium transport channel extending into said annular and circular channel region, within said annular and circular channel region the filling channel separating and sealing said medium supply channel from said medium transport channel to prevent flow of fluid or medium therebetween, said medium supply channel and said medium transport channel being separated fluid-tight from one another in said filling channel with said annular and circular channel region of said filling mandrel and having at least one of the same input and output directions; and a wall of the filling mandrel delimiting said filling channel, being oval with a reduced cross-sectional dimension in a transverse direction and a larger cross-sectional dimension in a longitudinal direction and adjoining an inside wall of said annular and circular channel region separating sickle-shaped free cross sections of said medium supply channel and said medium transport channel.

2. A device according to claim 1 wherein said medium transport channel removes displacement fluid and oxygen from the container or supplies displacement fluid to the container.

3. A device according to claim 1 wherein said filling channel projects over said medium supply channel and said medium transport channel forms said filling mandrel.

4. A device according to claim 1 wherein another medium supply channel is concentrically located between said wall of said filling mandrel and an outside wall of said supply device encompassing said wall of said filling mandrel.

5. A device according to claim 1 wherein said displacement fluid is a noble gas selected from the group consisting of argon gas, inert gas and nitrogen gas.

6. A device according to claim 1 wherein another supply device is provided on said filling mandrel providing a blocking medium to a region surrounding the container being filled.

7. A device according to claim 6 wherein said blocking medium is a noble gas selected from the group consisting of argon gas, inert gas and nitrogen gas.

8. A device for minimizing oxygen content in containers to be filled, comprising:

a filling device conveying a product to fill an open container, said filling device having a filling mandrel with a filling channel;

a supply device conveying a displacing fluid to displace oxygen out of the container before sealing of the container, said supply device having a first medium supply channel delivering the displacement fluid to the container and being a component of the filling device, said filling channel and said first medium supply channel being separated along entire lengths thereof;

a medium transport channel in said filling device having a free cross section;

an annular and circular channel region in said filling mandrel and having a cross section larger than a cross section at said medium transport channel, said medium transport channel extending into said annular and circular channel region, within said annular and circular channel region the filling channel separating and sealing said medium supply channel from said medium transport channel to prevent flow of fluid or medium therebetween;

a wall of the filling mandrel delimiting said filling channel, being oval with a reduced cross-sectional dimension in a transverse direction and a larger cross-sectional dimension in a longitudinal direction and adjoining an inside wall of said annular and circular channel region separating sickle-shaped free cross sections of said medium supply channel and said medium transport channel; and another medium supply channel concentrically located between said wall of said filling mandrel and an outside wall of said supply device encompassing said wall of said filling mandrel.

9. A device according to claim 8 wherein said medium transport channel removes displacement fluid and oxygen from the container or supplies displacement fluid to the container.

10. A device according to claim 8 wherein said filling channel projects over said medium supply channel and said medium transport channel forms said filling mandrel.

11. A device according to claim 8 wherein said displacement fluid is a noble gas selected from the group consisting of argon gas, inert gas and nitrogen gas.

12. A device according to claim 8 wherein another supply device is provided on said filling mandrel providing a blocking medium to a region surrounding the container being filled.

13. A device according to claim 12 wherein said blocking medium is a noble gas selected from the group consisting of argon gas, inert gas and nitrogen gas.

* * * * *